US012789862B2

(12) United States Patent
Bleth et al.

(10) Patent No.: US 12,789,862 B2
(45) Date of Patent: Nov. 10, 2026

(54) BANISTER ARRANGEMENT FOR A RAIL VEHICLE

(71) Applicant: Siemens Mobility GmbH, Munich (DE)

(72) Inventors: Sebastian Bleth, Munich (DE); Jörg Melde, Olching (DE); Jörg Pforr, Moosach (DE)

(73) Assignee: Siemens Mobility GmbH, Munich (DE)

( * ) Notice: Subject to any disclaimer, the term of this patent is extended or adjusted under 35 U.S.C. 154(b) by 676 days.

(21) Appl. No.: 18/263,750

(22) PCT Filed: Dec. 6, 2021

(86) PCT No.: PCT/EP2021/084377
§ 371 (c)(1),
(2) Date: Jan. 18, 2024

(87) PCT Pub. No.: WO2022/161673
PCT Pub. Date: Aug. 4, 2022

(65) Prior Publication Data

US 2024/0140499 A1 May 2, 2024

(30) Foreign Application Priority Data

Feb. 1, 2021 (DE) ..... 10 2021 200 873.9

(51) Int. Cl.
*B61D 23/00* (2006.01)

(52) U.S. Cl.
CPC ..... *B61D 23/00* (2013.01)

(58) Field of Classification Search
CPC ..... B61D 23/00; B61D 23/02; B61D 23/025
See application file for complete search history.

(56) References Cited

U.S. PATENT DOCUMENTS 3,945,003 A * 3/1976 Borg ..... H03J 1/045 340/332
3,997,183 A * 12/1976 Russey ..... B60R 3/02 280/166

(Continued)

FOREIGN PATENT DOCUMENTS

CN 103448737 A * 12/2013 ..... B61C 17/04
CN 109955861 A 7/2019

(Continued)

OTHER PUBLICATIONS

Norm DIN EN 16116-1 2014-01-00.; "Bahnanwendungen—Konstruktionsanforderungen an Tritte, Handgriffe und zugehörige Zugänge für das Personal—Teil 1: Personenfahrzeuge, Gepäckwagen und Lokomotiven; Deutsche Fassung"; EN 16116-1:2013 [Railway applications—Design requirements for steps, handrails and associated access for staff—Part 1: Passenger vehicles, luggage vans and locomotives: German version EN 16116-1:2013]—English abstract.

(Continued)

*Primary Examiner* — Jason C Smith
(74) *Attorney, Agent, or Firm* — Laurence A. Greenberg; Werner H. Stemer; Ralph E. Locher

(57) ABSTRACT

A banister arrangement for a rail vehicle has a banister element and a holding element. The banister element is rotatable about an axis of rotation. The holding element is designed in such a way that it is attached or attachable as intended to the outside of a rail vehicle in such a manner that the axis of rotation is vertically aligned. There is also described a rail vehicle with such a banister arrangement and a method for operating such a banister arrangement.

19 Claims, 3 Drawing Sheets

(56) References Cited

U.S. PATENT DOCUMENTS

| | | | | |
|---|---|---|---|---|
| 5,046,582 | A * | 9/1991 | Albrecht | B60R 3/02 182/127 |
| 5,921,531 | A * | 7/1999 | Early | B60R 3/005 105/457 |
| 8,651,434 | B2 * | 2/2014 | Daum | B61L 3/04 246/178 |
| 8,919,260 | B2 * | 12/2014 | Muller | B61D 17/02 105/59 |
| 9,045,906 | B1 * | 6/2015 | Richey | E04D 13/0357 |
| 10,196,078 | B2 * | 2/2019 | Shubs, Jr. | B61L 25/028 |
| 2011/0265685 | A1 * | 11/2011 | Swygert | E06C 7/16 182/127 |
| 2014/0026965 | A1 * | 1/2014 | Barrett | B60R 3/005 137/1 |
| 2017/0151970 | A1 * | 6/2017 | Shubs, Jr. | B61L 15/0081 |
| 2024/0140499 | A1 * | 5/2024 | Bleth | B61D 23/00 |

FOREIGN PATENT DOCUMENTS

| | | | | |
|---|---|---|---|---|
| DE | 19928494 | A1 | 1/2001 | |
| DE | 102006032335 | B4 * | 4/2008 | B61C 3/00 |
| DE | 202010016195 | U1 | 3/2011 | |
| DE | 102012104987 | A1 * | 12/2013 | B61D 23/00 |
| EP | 1481936 | A1 * | 12/2004 | B66B 13/24 |
| EP | 1808335 | A1 * | 7/2007 | B60R 3/005 |
| EP | 1808335 | B1 | 10/2008 | |
| EP | 3663943 | A1 * | 6/2020 | G06F 30/15 |
| EP | 3945003 | A1 | 2/2022 | |
| WO | WO-2023131440 | A1 * | 7/2023 | B61D 27/009 |
| WO | WO-2024052160 | A1 * | 3/2024 | B61C 17/04 |

OTHER PUBLICATIONS

Norm DIN EN 16116-2 2014-01-00.; "Bahnanwendungen—Konstruktionsanforderungen an Tritte, Handgriffe und zugehörige Zugänge für das Personal—Teil 2: Güterwagen; Deutsche Fassung"; EN 16116-2:2013 [Railway applications—Design requirements for steps, handrails and associated for staff—Part 2: Freight wagons; German version EN 16116-2:2013—English abstract.

* cited by examiner

BANISTER ARRANGEMENT FOR A RAIL VEHICLE

FIELD AND BACKGROUND OF THE INVENTION

The invention relates to a banister arrangement for a rail vehicle, in particular for a rail vehicle having an end cab. The invention furthermore comprises a rail vehicle having such a banister arrangement, and a method for handling such a banister arrangement. In particular, the invention comprises a two-position hand bar and step combination.

The space provided at the corners of the front end region (or "of the front end regions", depending on the use) of a rail vehicle having an end cab is restricted by diverse attachments, e.g. actuations for couplings or crash elements or the contour of the front end nose, in such a manner that an arrangement, which is customary for rail vehicles having a central cab, of footsteps and handlebars for switching purposes in accordance with a customary standard (e.g. EN16116-1 or -2) and resulting spaces to be kept free for handlebars and switchman's footsteps can be realized only with difficulty, if at all, because of a lack of space.

This applies in particular to handlebars and footsteps for switching purposes in conjunction with an access to the upper footstep plane in rail vehicles having an end cab, the handlebars and footsteps being used for maintenance purposes, e.g. for cleaning the front window.

This problem has specifically not yet occurred up to now in rail vehicles having an end cab for switching purposes since up to now only rail vehicles having central cabs have been used for switching purposes (with a switchman's footstep according to EN16116-1).

In certain types of freight cars (e.g. flat cars), use is made of hand bars which can be partially folded away and, in the folded-up state, do not restrict the space for the freight and, in the unfolded state, ensure a gripping possibility for the switchman. However, this principle cannot be used for a rail vehicle having an end cab.

SUMMARY OF THE INVENTION

It is an object of the present invention to specify a banister arrangement and a method for handling such a banister arrangement, with which the above-described disadvantages are avoided and in particular secure holding is ensured.

This object is achieved by a banister arrangement as claimed, a rail vehicle as claimed and a method as claimed.

A banister arrangement according to the invention for a rail vehicle, in particular an end cab locomotive, comprises a banister element and a holding element in which the banister element is arranged (mounted) so as to be rotatable about an axis of rotation. The holding element is configured here in such a manner that it is attached or is attachable as intended to the outside in the front end region of a rail vehicle such that the axis of rotation is oriented vertically.

A banister arrangement can also be referred to as a "handlebar arrangement" or "footstep bar arrangement" depending on the designated position on a rail vehicle. For example, a banister arrangement arranged at a low level can also serve as a footstep and one arranged at a high level as a grip. However, a banister arrangement can also serve both as a grip and as a footstep, e.g. as a footstep rung, if the banister arrangement serves as a type of ladder.

A rail vehicle according to the invention comprises a banister arrangement according to the invention, wherein the holding element is arranged in the external region, in particular in the front end region, or in the region of a buffer, in such a manner that the axis of rotation is oriented vertically.

The banister arrangement is therefore attached rotatably to the rail vehicle and can thus be pivoted into different positions. Preferred positions are a position for switching purposes ("switching position") and a position for maintenance purposes ("maintenance position").

In the switching position, the banister arrangement is intended to be situated in such a manner that it provides a gripping option for holding during the switching operation, in particular when using a remote control. It would furthermore be advantageous if, in the event of a switchman's step being present in the front end region, said switchman's step is correspondingly delimited on one side by a banister element of the banister arrangement. In addition, in the switching position, the banister arrangement is intended to block access to an upper footstep plane for working protection reasons. Such access is not necessary in switching operation. The banister arrangement is intended to be oriented in the switching position in such a manner that it provides securing from the front toward the buffer and an additional possibility for taking up the secure switching position. For this purpose, it does not have to be located in front of the switchman's footstep (on the side facing away from the rail vehicle), but better delimit the side which faces a buffer (next to the switchman's footstep) since a path to an upper footstep plane arranged above the buffer can thereby be effectively blocked.

In addition, a clearance is intended to be ensured above the switchman's footstep in accordance with the standard, i.e. the space is not obstructed by footstep steps to an upper footstep plane. An embodiment which achieves this will be described further below.

For maintenance purposes, the banister arrangement is intended to be able to be rotated from the switching position into the maintenance position (and optionally fixed), as a result of which the path to the upper footstep becomes free.

At the same time, the banister arrangement is intended to provide a gripping option when climbing up and climbing down, and a safety area forward toward the buffer for working protection reasons. For this purpose, a banister element is preferably rotated in such a manner that it is now located in front of the upper footstep (on the side facing away from the rail vehicle). It would also be desirable if, in the maintenance position, the banister arrangement were to provide additional footstep steps to safely reach the upper footstep, in a manner meeting the needs of working protection, in the clearance of the switchman's step. Such an embodiment will be described further below.

A method according to the invention for handling a banister arrangement according to the invention on a rail vehicle according to the invention comprises the following steps. A (or the) banister element of the banister arrangement is fixable here by means of a locking element. The steps are:

- releasing the fixing of a banister element, in particular releasing the banister element from a further locking element,
- rotating the banister element about the vertical axis of rotation in the holding element into another position, in particular from a maintenance position into a switching position or vice versa,
- fixing the banister element by the locking element.

The banister element, which can be a hand bar or a footstep, can therefore be rotated into at least two positions in which it can be locked. The two lockable positions are intended to be the switching position and the maintenance position.

Further, particularly advantageous embodiments and refinements of the invention will emerge from the dependent claims and from the following description, wherein the claims of one claim category may also be refined analogously to the claims and description parts of another claim category, and in particular also individual features of different exemplary embodiments or variants may be combined to form new exemplary embodiments or variants.

According to a preferred embodiment of the banister arrangement, the banister element comprises bars which are arranged parallel and/or orthogonally to the axis of rotation. Here, the bars are intended to have a diameter of greater than 2 cm, but smaller than 10 cm, so that they can readily be grasped and so that they can be used as comfortable footsteps. It is preferred here if at least some of the bars arranged in parallel are designed as handlebars and/or at least some of the orthogonally arranged bars are designed as footstep bars. It should be noted that, in the event of rotation about the vertical axis of rotation, the orientation of the bars (parallel or orthogonally) to said axis of rotation does not change and the bars can continue to be used as a grip or footstep, or simply just for blocking. The bars are preferably hollow.

A preferred embodiment of the banister arrangement comprises at least two banister elements on opposite sides of the holding element, preferably one above the holding element (with respect to the axis of rotation) and one below the holding element. The banister elements are preferably fixedly connected here to one another by a rigid bar and are jointly rotatable about the axis of rotation. Alternatively, they can also be unconnected and rotatable independently of one another about the axis of rotation.

It is preferred that the banister elements are preferably rotated or rotatable by 90° with respect to one another about the axis of rotation, i.e. they are or can be oriented orthogonally to one another. Therefore, in the connected case, it is possible, for example, for an (upper) banister element to secure a switchman's footstep to the side (toward a buffer) and to serve as a grip and for a (lower) banister element to secure the switchman's footstep forward. The term "to the side" means that the plane of a banister element is oriented vertically and parallel to the longitudinal axis of the rail vehicle, and the term "forward" means that the plane of a banister element is oriented vertically and orthogonally to the longitudinal axis of the rail vehicle.

According to a preferred embodiment of the banister arrangement, at least one banister element is lockable or fixable. For this purpose, it preferably has a locking element in the region of the axis of rotation or remote from the axis of rotation. Thus, the banister element can therefore be fixed in preferred positions, e.g. in the abovementioned switching position and/or the maintenance position, and therefore an unintentional rotational movement is prevented. This serves for secure holding or for ensuring a safety feature. The locking element does not necessarily have to be part of the banister arrangement here. It suffices if the banister arrangement is formed at predetermined points in such a manner that it can engage in a locking element or can be held by the latter. For example, in a very simple case, a banister element can have at the bottom a vertical tube end which can engage in a hole in a plate on the rail vehicle.

According to a preferred embodiment, the banister arrangement is a steel tube structure or a plastics tube structure. The tubes can be hollow or compact here (i.e. bars made of solid material). However, hollow elements are preferred since they have a lower weight while having sufficient strength.

A preferred embodiment of the rail vehicle comprises an end cab, wherein the banister arrangement is attached in the region next to or in front of the end cab, preferably in the region of buffers of the rail vehicle. Said buffers are preferably attached here in such a manner that a switchman's stand according to a current standard, e.g. the standard EN16116-1, can be attached between the end cab and the buffer plate. A preferred end cab locomotive for switching operation comprises buffer systems, an end cab and a switchman's footstep in front of the end cab on the side of a first buffer system. The switchman's footstep is arranged here in such a manner that, when the buffer is completely elastically pushed in, the buffer plane lies in front of the switchman's footstep. The space above the switchman's footstep, i.e. the space which is spanned by the vertical projection of the switchman's footstep, therefore lies outside the clearance of the first buffer system. The banister arrangement is preferably arranged on this rail vehicle in such a manner that, when the buffer is completely elastically pushed in, the buffer plane lies in front of the banister arrangement. The banister arrangement therefore preferably lies outside the clearance of the buffers of the rail vehicle.

According to a preferred embodiment of the rail vehicle, the (or a) banister element comprises bars which are arranged parallel and/or orthogonally to the axis of rotation (see above). It is preferred here that at least some of the bars which are arranged parallel to the axis of rotation and are arranged above a buffer of the rail vehicle are designed as gripping bars. It is similarly preferred for at least some of the bars which are arranged orthogonally with respect to the axis of rotation and are arranged under a buffer of the rail vehicle are designed as footstep bars. When a person is standing on a switchman's footstep, this region is located below the buffer in the region of the person's legs, and therefore a footstep is advantageous there if the person wants to climb to an upper level. A banister above the buffers is located in the region of the person's arms, and therefore a grip is advantageous there.

A preferred embodiment of the rail vehicle comprises a number of blocking elements which are configured and arranged in such a manner that they can releasably fix a banister element of the banister arrangement in a predetermined position. The locking elements do not absolutely have to be located on the banister arrangement; instead, they can be arranged in particular on a footstep. In a simple case, they can be holes in a footstep plate, into which a tube end of a banister element can be introduced. Preferably, a number of locking elements are arranged in such a manner that they can fix a part of the banister element that is remote from the axis of rotation. This increases the lever effect of the locking elements.

A preferred embodiment of the rail vehicle is configured with a number of locking elements to such an extent that a (the) banister element can be fixed in two different positions. These positions preferably correspond to an angle of rotation of at least 70° about the axis of rotation, particularly preferably of at least 80°. Preferred positions lie rotated with respect to one another about the axis of rotation in particular by an angle of rotation of 90°.

A preferred embodiment of the rail vehicle additionally comprises a footstep (e.g. for maintenance or switching purposes) which is arranged in particular in the region of a buffer of the rail vehicle. The term "footstep" normally refers to a standing surface. If a footstep has a banister or a holding bar, it may also be referred to as a "stand".

For example, a switchman's footstep can be arranged offset somewhat laterally under the buffer, or a maintenance footstep can be arranged on or above the buffer or a crash element on the buffer. Said footstep is intended to be delimited on at least one side by a banister element of the banister arrangement (and therefore in particular to form a stand). The rail vehicle preferably comprises here at least two footsteps in the region of the buffer, e.g. the abovementioned switchman's footstep and maintenance footstep which are jointly delimited on at least one of their sides by at least one banister element of the banister arrangement. The invention is particularly advantageous for such an arrangement since the rotatability of the banister arrangement can now ensure changing accesses or degrees of safety. The delimitation by the banister element is preferably such that it forms a barrier in a position of the banister arrangement between the two footsteps and lies in particular on a vertically oriented plane which, in the case of blocking, is preferably oriented parallel to the longitudinal axis of the rail vehicle.

A preferred embodiment of the rail vehicle comprises an upper footstep (maintenance footstep) above a buffer of the rail vehicle (e.g. on or above the buffer or a crash element of the buffer) and a lower footstep (switchman's footstep) below the buffer (and somewhat laterally offset), which footsteps are jointly delimited on at least one side by at least one (upper) banister element of the banister arrangement. Said banister element preferably reaches at least 70 cm, in particular at least 90 cm or even one meter above the upper footstep, and therefore it can be used as a banister and/or handle for both footsteps.

It is preferred here that the banister element can be rotated about the axis of rotation into a first position (the maintenance position) in which it permits access from the lower footstep to the upper footstep and, as a banister, preferably additionally delimits the upper footstep on its side facing away from the rail vehicle. Furthermore, it is preferred that the banister element can be rotated about the axis of rotation into a second position (the switching position) in which it blocks access from the lower footstep to the upper one and preferably can additionally be used as a grip for a person standing on the lower footstep.

A preferred embodiment of the rail vehicle comprises a (lower) banister element which is arranged in the height region between the aforementioned footsteps and can be used as a banister and also as a step or ladder. It is preferred here for said banister element to be able to be rotated about the axis of rotation into a first position (maintenance position) in which it can serve as a step/ladder from the lower footstep to the upper footstep and, as a banister, preferably additionally delimits the lower footstep from the buffers of the rail vehicle, and can be rotated into a second position (switching position) in which, as a banister, it delimits the lower footstep on its side facing away from the rail vehicle. The (lower) banister element mentioned here is preferably advantageous in combination with the aforementioned (upper) banister element. In particular if the two banister elements lie on a respective plane which are rotated 90° with respect to one another about the axis of rotation. If the (upper) banister element is oriented parallel to the longitudinal axis of the rail vehicle, the (lower) banister element is preferably orthogonal thereto, and vice versa.

A preferred embodiment of the rail vehicle additionally comprises a mounting interface for attaching the banister arrangement to a buffer of the rail vehicle, said mounting interface comprising a mounting body with a component-fastening region and an attachment region different therefrom, wherein the component-fastening region is provided with fastening elements and/or holes for attaching the components, and the attachment region is shaped in such a manner that it can be fastened at at least two fastening points of a buffer flange of the buffer (also sometimes referred to as a "buffer baseplate") with buffer screws (as a rule commercially available screws). The space available is thereby optimally used and therefore the standardized requirements for switching met.

An advantage of the invention is ensuring a secure hold for a person in the front end region of a rail vehicle having an end cab during switching operation, in particular associated with a simultaneous blocking of access to an upper footstep plane for working protection reasons during switching operation. The possibility of moving the banister arrangement brings about a further advantage of ensuring access (climbing up and climbing down) to an upper footstep in the event of maintenance, in particular associated with a simultaneous safety barrier forward in the region of the buffer. A standard locomotive of a main line locomotive (not intended for switching purposes) can thus be reequipped to such an extent that it can also be used for switching purposes.

The invention will also be explained once again in detail below with reference to the attached figures using exemplary embodiments. The same components in the various figures are provided with identical reference numbers here. The FIGS. are generally not to scale. In the figures:

DETAILED DESCRIPTION OF THE INVENTION

Figure 1:
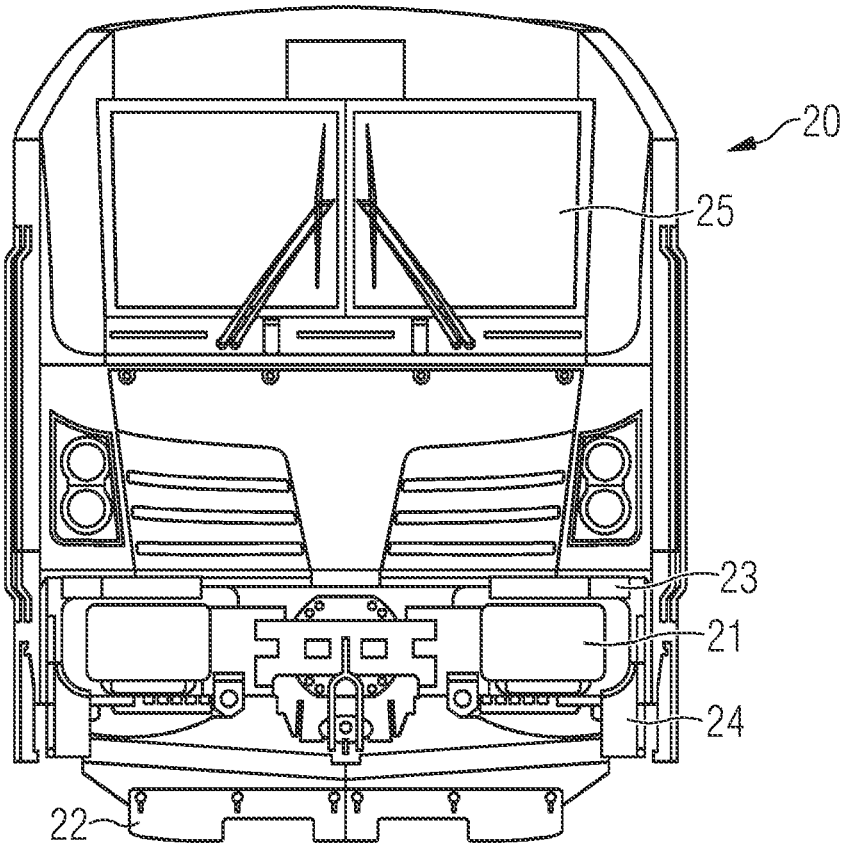
FIG 1 PRIOR ART
FIG. 1 shows a rail vehicle according to the prior art.
Figure 1:
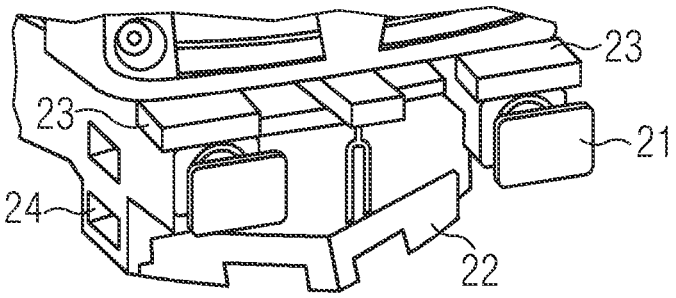
FIG 1 PRIOR ART

FIG. 1 shows a rail vehicle 20 with an end cab 25 according to the prior art from the front and the buffer region thereof additionally also once again in a perspective view for better clarity. This is a typical design of the front end region of a rail vehicle 1 with an end cab 25. The buffers 21 and the front apron 22 can clearly be seen. An upper footstep plane 23 which can be reached via footsteps 24 on the side of the rail vehicle 20 is arranged on the buffers for maintenance purposes. Due to the restricted space provided, there is no space here for a switchman's footstep according to standard EN16116, but merely for the footsteps and the footstep plane (neither of which are a switchman's footstep according to the standard EN16116).

Figure 2:
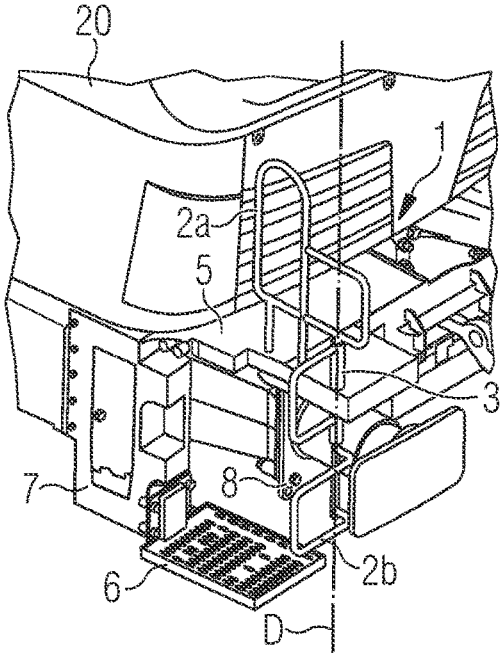
FIG. 2 shows a rail vehicle with a preferred banister arrangement in the switching position.

FIG. 2 shows a rail vehicle 20 with a preferred banister arrangement 1 in the switching position. Part of the perspective detail from FIG. 1 can be seen from a somewhat different viewing angle. A preferred banister arrangement 1 according to the invention is illustrated with an upper banister element 2*a* and a lower banister element 2*b* which are both mounted lying opposite one another in a rotatable manner in a holding element 3 (one above the holding element 3 and one below) such that they can rotate about a vertical axis of rotation D (chain-dotted line). In this example, for better understanding of the orientations, described below, of the banister elements 2*a*, 2*b*, it can be presented that the upper banister element 2*a* is fixedly connected to the lower banister element 2*b* via a continuous bar, and therefore, when the upper banister element 2*a* rotates, the lower banister element 2*b* correspondingly rotates therewith.

In the front end region, the rail vehicle 20 has a maintenance footstep 5 as the upper footstep and a switchman's footstep 6, which is mounted on a mounting 7, as the lower footstep. On the maintenance footstep 5 it is possible, for example, to reach the windows of the end cab 25 of the rail vehicle (20) in order to clean them. A person can stand on the switchman's footstep 6 during switching operation. It corresponds here to the specifications of the standard EN16116-2.

In this example, the maintenance footstep 5 is attached directly to the buffer 21 by means of a mounting interface 8. The mounting interface 8 is located here between the buffer flange of the buffer 21 and a crash element (not denoted in detail) and is fastened there with the buffer screws.

The banister elements 2*a*, 2*b* of the banister arrangement 1 are manufactured here from bars (or tubes) which are preferably hollow and are preferably a steel tube structure. In the upper banister element 2*a*, the bars run largely parallel to the axis of rotation D so that they can readily serve as handlebars. In the lower banister element 2*b*, the bars largely run orthogonally to the axis of rotation D so that they can readily serve as footstep bars.

The banister arrangement 1 is positioned in such a manner that it delimits the two footsteps 5, 6 on at least one of the sides thereof with a banister element 2*a*, 2*b*. The banister arrangement 1 can be rotated here into a switching position and into a maintenance position and fixed there (see FIG. 4).

FIG. 2 shows the banister arrangement 1 in the switching position. In this position, access from the switchman's footstep 6 to the maintenance footstep 5 is blocked by the upper banister element 2*a* which can additionally be used as a grip for a person standing on the switchman's footstep 6. The lower banister element 2*b*, which is arranged at the height between the footsteps 5, 6, is used here as a banister and delimits the switchman's footstep 6 on its side facing away from the rail vehicle 20.

Figure 3:
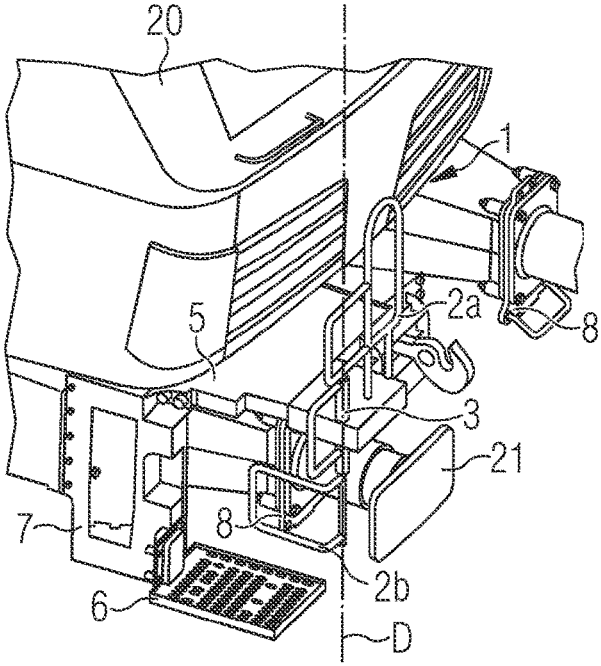
FIG. 3 shows a rail vehicle with a preferred banister arrangement in the maintenance position.

FIG. 3 corresponds to FIG. 2 with the difference that the banister arrangement 1 is rotated there into the maintenance position. In the maintenance position, access from the switchman's footstep 6 to the maintenance footstep 5 is permitted since the upper banister element has now been pivoted forward and forward delimits the front side of the maintenance footstep 5 (against falling off therefrom). Therefore, at the same time, the transition between the switchman's footstep 6 to the maintenance footstep 5 is free, and the lower banister element 2*b* can serve as a step from the switchman's footstep 6 to the maintenance footstep 5 and, as a banister, additionally delimits the switchman's footstep 6 from the buffers 21 of the rail vehicle 20.

Figure 4:
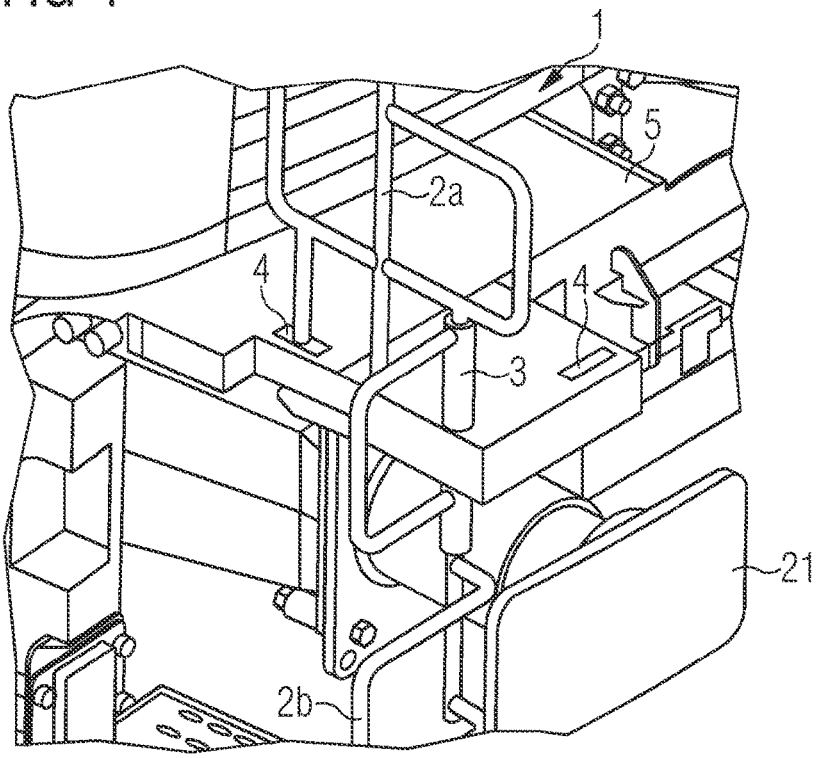
FIG. 4 shows a larger detail from FIG. 2.

FIG. 4 shows a larger detail of FIG. 2. In contrast to FIG. 2, locking elements 4 are indicated here by means of which the upper banister element 2*a* can be fixed. The movable handlebar, which here forms the upper banister element 2*a*, can be locked in two positions, the switching position and the maintenance position, and therefore an unintentional rotational movement can be prevented. If the lower banister element 2*b*, as stated above, is connected to the upper banister element 2*a* via a rod, it is automatically fixed at the same time by the locking of the upper banister element 2*a*. In a very simple embodiment, a locking element 4 can simply be a hole in the maintenance footstep 5. The banister arrangement can then be simply raised, rotated and plugged with a vertical bar of the upper banister element 2*a* into the closest hole in order to fix it.

In this example, there are two locking elements 4, and therefore the banister arrangement 1 can be fixed in the two different positions according to FIGS. 2 and 3, which positions differ by an angle of rotation of 90°.

Figure 5:
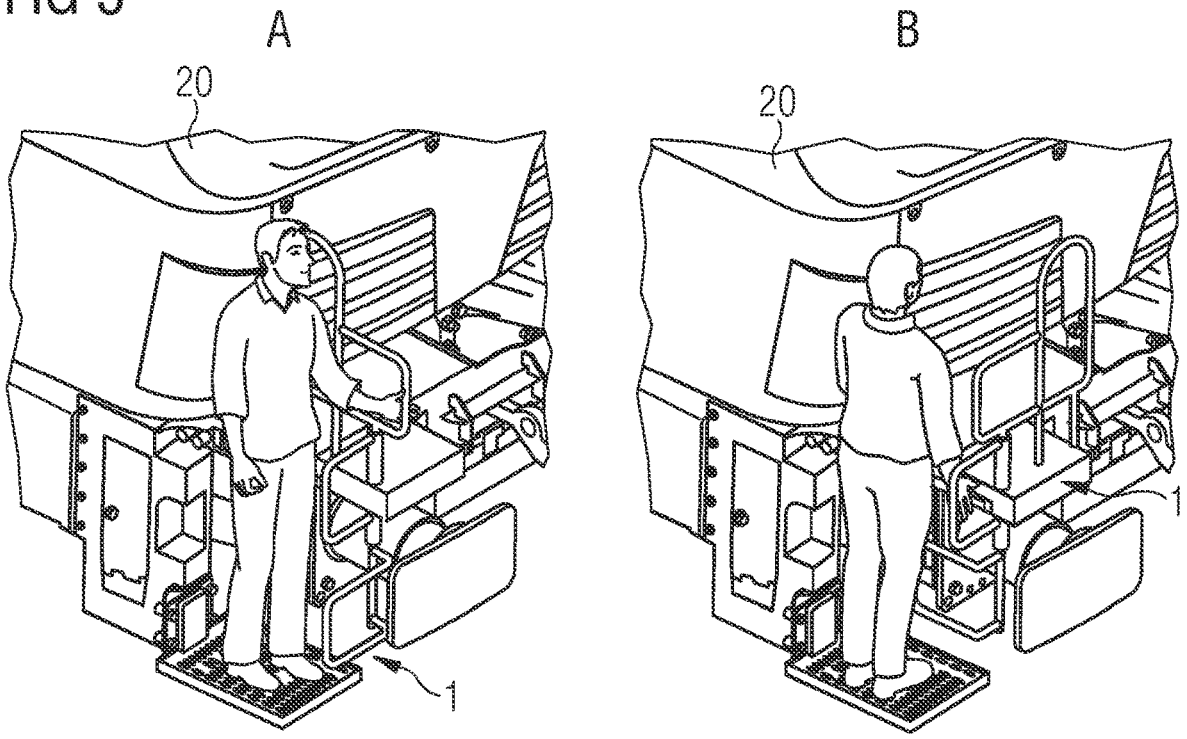
FIG. 5 shows a rail vehicle with a preferred banister arrangement in relation to a person.

FIG. 5 shows a rail vehicle 20 with a preferred banister arrangement 1 in the switching position A and the maintenance position B, as are shown in FIGS. 2 and 3 in relation to a person.

In conclusion, attention is once again drawn to the fact that the embodiments described in detail above and in the method are merely exemplary embodiments which can be modified in many different ways by a person skilled in the art without leaving the scope of the invention. Moreover, the use of the indefinite article "a" or "an" does not exclude the possibility that there may be more than one of the features concerned. In addition, terms such as "unit" do not exclude the fact that the components concerned consist of a plurality of interacting subcomponents which may optionally also be arranged in a spatially distributed manner.

The invention claimed is:

1. A banister arrangement for a rail vehicle that is equipped with a buffer, an upper footstep above the buffer, and a lower footstep below the buffer, the banister arrangement comprising:

a banister element and a holding element rotatably supporting said banister element about an axis of rotation;

said holding element being attached, or configured for attachment, to an exterior front-end region of the rail vehicle with the axis of rotation being oriented vertically; and wherein:

said banister element is configured to delimit the upper footstep and the lower footstep on at least one side of the banister arrangement, and the banister arrangement is configured as a banister and/or handle for the upper and lower footsteps;

said banister element is rotatably mounted for rotation about the axis of rotation:

into a first position in which said banister element permits access from the lower footstep to the upper footstep and additionally delimits the upper footstep on a side thereof facing away from the rail vehicle; and into a second position in which said banister element blocks access from the lower footstep to the upper footstep and is additionally usable as a handrail for a person standing on the lower footstep.

2. The banister arrangement according to claim 1, wherein:

said banister element is at least two banister elements on mutually opposite sides of said holding element, said banister elements are fixedly connected to one another by a rigid bar and are jointly rotatable about the axis of rotation; and said banister elements are rotated or rotatable by 90° relative to one another about the axis of rotation.

3. The banister arrangement according to claim 1, wherein:

said banister element is at least two banister elements on mutually opposite sides of said holding element, said banister elements are unconnected and are rotatable independently of one another about the axis of rotation; and said banister elements are rotated or rotatable by 90° relative to one another about the axis of rotation.

4. The banister arrangement according to claim 1, wherein said banister element is at least two banister elements, and at least one of said banister elements is lockable by a locking element in a region of the axis of rotation or remote from the axis of rotation.

5. The banister arrangement according to claim 1, formed as a steel tube structure or a plastics tube structure.

6. A rail vehicle, comprising a banister arrangement according to claim 1 having the holding element in an outer region of the rail vehicle, with the axis of rotation oriented vertically.

7. The rail vehicle according to claim 6, comprising an end cab, and wherein the banister arrangement is attached adjacent said end cab or in front of said end cab.

8. The rail vehicle according to claim 7, comprising buffers of the rail vehicle, and wherein the banister arrangement is attached in a vicinity of said buffers of the rail vehicle.

9. The rail vehicle according to claim 6, wherein the banister element comprises bars extending parallel to the axis of rotation and/or bars extending orthogonally to the axis of rotation, and wherein:

at least some of said bars that extend parallel to the axis of rotation and are disposed above a buffer of the rail vehicle are handlebars; and/or at least some of said bars that extend orthogonally to the axis of rotation and are disposed below a buffer of the rail vehicle are footstep bars.

10. The rail vehicle according to claim 6, comprising a number of locking elements configured and arranged for releasably fixing a banister element of the banister arrangement in a predetermined position.

11. The rail vehicle according to claim 10, wherein said locking elements are arranged for fixing a part of the banister element that is remote from the axis of rotation.

12. The rail vehicle according to claim 10, wherein said locking elements enable the banister element of the banister arrangement to be fixed in two different positions which correspond to an angle of rotation of at least 70° about the axis of rotation.

13. The rail vehicle according to claim 10, wherein the two different positions correspond to an angle of rotation of substantially 90° about the axis of rotation.

14. The rail vehicle according to claim 6, further comprising at least two footsteps arranged in a region of a buffer of the rail vehicle, said footsteps being jointly delimited on at least one side by at least one banister element of the banister arrangement.

15. The rail vehicle according to claim 6, comprising an upper footstep above a buffer of the rail vehicle and a lower footstep below the buffer, said upper and lower footsteps being jointly delimited on at least one side by a banister element of the banister arrangement.

16. The rail vehicle according to claim 15, wherein said banister element reaches at least 70 cm over said upper footstep and is configured for use as a banister and/or a handle for said upper and lower footsteps, and said banister element is rotatably mounted about the axis of rotation:

into a first position in which said banister element permits access from said lower footstep to said upper footstep and forms a banister that additionally delimits said upper footstep on its side facing away from the rail vehicle, and into a second position in which said banister blocks access from the lower footstep to the upper footstep and is additionally usable as a handle for a person standing on said lower footstep.

17. The rail vehicle according to claim 16, wherein said banister arrangement includes a further banister element arranged at a level between said lower and upper footsteps and configured for use as a banister and as a step or ladder, and wherein said further banister element is rotatably mounted about the axis of rotation:

into a first position in which said further banister element serves as a footstep from said lower footstep to said upper footstep and forms a banister that additionally delimits said lower footstep with respect to the buffers of the rail vehicle; and into a second position in which said further banister element forms a banister that delimits said lower footstep on a side facing away from the rail vehicle.

18. The rail vehicle according to claim 6, further comprising a mounting interface for attaching said banister arrangement to a buffer of the rail vehicle, said mounting interface including a mounting body with a component-fastening region and an attachment region different therefrom, wherein said component-fastening region is provided with fastening elements and/or holes for attaching components of said banister arrangement, of said holding element, or of said footstep assembly, and said attachment region is shaped for fastening with buffer screws at at least two fastening points of a buffer flange of the buffer.

19. A method, comprising:

providing a banister arrangement according to claim 1 on a rail vehicle, wherein the banister arrangement has a banister element that is rotatably mounted in a holding element about a vertical axis of rotation and the banister element is fixable against rotation by a locking element;

releasing the locking element to enable a rotation of the banister element;

rotating the banister element about the vertical axis of rotation in the holding element, selectively between a maintenance position and a switching position; and fixing the banister element by the locking element.

* * * * *